US010697201B2

(12) United States Patent
Sharp

(10) Patent No.: US 10,697,201 B2
(45) Date of Patent: Jun. 30, 2020

(54) DOOR LOCK MECHANISM

(71) Applicant: Snap-on Incorporated, Kenosha, WI (US)

(72) Inventor: William T. Sharp, Pleasant Prairie, WI (US)

(73) Assignee: Snap-on Incorporated, Kenosha, WI (US)

( * ) Notice: Subject to any disclaimer, the term of this patent is extended or adjusted under 35 U.S.C. 154(b) by 354 days.

(21) Appl. No.: 14/719,362

(22) Filed: May 22, 2015

(65) Prior Publication Data

US 2016/0340943 A1 Nov. 24, 2016

(51) Int. Cl.

| | |
|---|---|
| ***E05B 47/02*** | (2006.01) |
| ***E05C 9/04*** | (2006.01) |
| ***E05B 47/00*** | (2006.01) |
| *E05B 15/04* | (2006.01) |

(52) U.S. Cl.

CPC ..... *E05B 47/026* (2013.01); *E05B 47/0004* (2013.01); *E05C 9/043* (2013.01); *E05B 2015/0493* (2013.01); *E05B 2047/0085* (2013.01); *E05B 2047/0094* (2013.01)

(58) Field of Classification Search

CPC ..... Y10S 292/31; Y10T 292/0853; Y10T 292/0838; Y10T 292/0839; Y10T 292/0972; Y10T 292/0974; Y10T 292/1047; Y10T 292/0962; Y10T 292/0963; Y10T 922/097; Y10T 292/0994; Y10T 292/1015

USPC ..... 292/140, 117, 119, 122, 123, 127, 292/157–159, 162–164, 168, DIG. 12

See application file for complete search history.

(56) References Cited

U.S. PATENT DOCUMENTS

| | | | | |
|---|---|---|---|---|
| 1,709,459 A * | 4/1929 | Callahan | ..... | F16J 13/08 220/326 |
| 4,136,578 A * | 1/1979 | Van Klompenburg | ..... | B60J 7/1642 292/DIG. 12 |
| 4,288,944 A * | 9/1981 | Donovan | | |
| 2003/0132232 A1 | 7/2003 | Eggum | | |

(Continued)

FOREIGN PATENT DOCUMENTS

| | | |
|---|---|---|
| CN | 1442151 C | 2/2006 |
| CN | 103459740 A | 12/2013 |
| CN | 202810423 U | 9/2014 |

(Continued)

OTHER PUBLICATIONS

Taiwan office Action, dated Jan. 19, 2017; 7 pages.

(Continued)

*Primary Examiner* — Mark A Williams

(74) *Attorney, Agent, or Firm* — Seyfarth Shaw LLP

(57) ABSTRACT

A door lock mechanism that rotates a cam mechanism to lock or unlock an enclosure. The mechanism includes a bias member that is coupled to the cam mechanism with a cam pin, where the cam pin is located on one side of the centerline of the lock in the locked state, and on the other side of the centerline of the lock in the unlocked state, to bias the cam mechanism into either the locked or unlocked state. Further disclosed are one or more stop mechanisms that prevent the cam mechanism from over-rotating past the locked or unlocked position. The bias member can further absorb impact from the lock rods of the door lock mechanism contacting the stop mechanisms.

13 Claims, 4 Drawing Sheets

(56) References Cited

U.S. PATENT DOCUMENTS

2007/0084865 A1* 4/2007 Moore ..... B65F 1/1615
220/326

FOREIGN PATENT DOCUMENTS

| | | |
|---|---|---|
| CN | 203967544 U | 11/2014 |
| EP | 2011939 | 1/2009 |
| GB | 270053 | 5/1927 |
| JP | H0216275 | 1/1990 |
| TW | 494962 | 1/2002 |
| WO | 2013099601 | 4/2013 |

OTHER PUBLICATIONS

Canadian Intellectual Property Office Examiners Report, dated Sep. 12, 2016; 3 pages.
Canadian Office Action for Application No. 2916013 dated Jun. 22, 2017, 4 pages.
Chinese Office Action for Application No. 201610145782.7 dated Jan. 26, 2018, 10 pages.
Great Britain Office Action for Application No. 1522033.8 dated Oct. 11, 2017, 3 pages.
Great Britain Combined Search and Examination Report for Application No. 1802872.0 dated Mar. 28, 2018, 7 pages.
Australian Examination Report No. 1 for Application No. 2015264901 dated Feb. 19, 2019, 3 pages.
Great Britain Examination Report for Application No. 1802872.0 dated Nov. 16, 2018, 4 pages.
Chinese Office Action for Application No. 201610145782.7 dated Sep. 10, 2018, 11 pages.

* cited by examiner

DOOR LOCK MECHANISM

TECHNICAL FIELD OF THE INVENTION

The present invention relates generally to door lock mechanisms. More particularly, the present invention relates to a door lock mechanism that can be opened using a key or remote actuator.

BACKGROUND OF THE INVENTION

Door lock mechanisms are found in many enclosures, such as tool carts and roll cabs. Most door lock mechanisms can be opened manually with a key, and others can be opened remotely with an actuator. The actuator is located inside the enclosure being locked and communicates with a remote through wireless or wired methods to more easily lock the enclosure.

Some door lock mechanisms use lock rods to engage the enclosure and prevent the opening of the door in a locked state. To unlock the door, the mechanism retracts the lock rod from the enclosure so the door can freely move. Many developments in door lock mechanisms are aimed at improving the mechanical and electrical functionality of the mechanism to create a smoother locking and unlocking process.

SUMMARY OF THE INVENTION

The present invention broadly comprises a door lock mechanism that rotates a cam mechanism to move lock rods into and out of an enclosure. In an embodiment, a bias member is coupled to the cam mechanism at a cam pin located on a side of the centerline of the lock in the locked state, and located on the opposing side of the centerline of the lock in the unlocked state. In this configuration, the bias member can cause the door lock mechanism to be biased into either of the locked or unlocked states, depending on the position of the cam mechanism.

In an embodiment, the door lock mechanism also includes one or more stop mechanisms to prevent the cam mechanism from over-rotating past the locked or unlocked positions. For example, the housing of the door lock mechanism can include a first stop mechanism at an upper point of the housing to abut a lock rod or cam mechanism in the locked state, and a second stop mechanism at a lower point in the housing to abut the other lock rod or another portion of the cam mechanism in the unlocked state. The bias member can further absorb impact from the lock rods of the door lock mechanism abutting the stop mechanisms. Of course, any location of stop mechanism and any number of lock rods or stop mechanisms can be implemented without departing from the spirit and scope of the present invention.

In another embodiment, the present invention broadly includes a door lock apparatus adapted to be locked and unlocked having a housing, a cam mechanism rotatably disposed within the housing, a first lock rod coupled to the cam mechanism, a bias member having first and second bias member ends, the first bias member end coupled to the housing at a housing pin and the second bias member end coupled to the cam mechanism at a cam pin, and a lock coupled to the housing and the cam mechanism and having a vertical centerline, wherein the housing pin is disposed substantially axially aligned with the vertical centerline such that, when the door lock mechanism is in a locked state, the cam pin is disposed on a first side of the vertical centerline, and when the door lock mechanism is in an unlocked state, the cam pin is disposed on a second side of the vertical centerline opposite the first side.

In yet another embodiment, the present invention broadly includes a door lock apparatus adapted to be locked and unlocked and having a housing, a cam mechanism rotatably disposed within the housing, a first lock rod coupled to the cam mechanism, and a first stop disposed within the housing and adapted to contact one of the cam mechanism and first lock rod to substantially prevent additional rotation of the cam mechanism and lock rod.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION OF THE EMBODIMENTS

Figure 1:
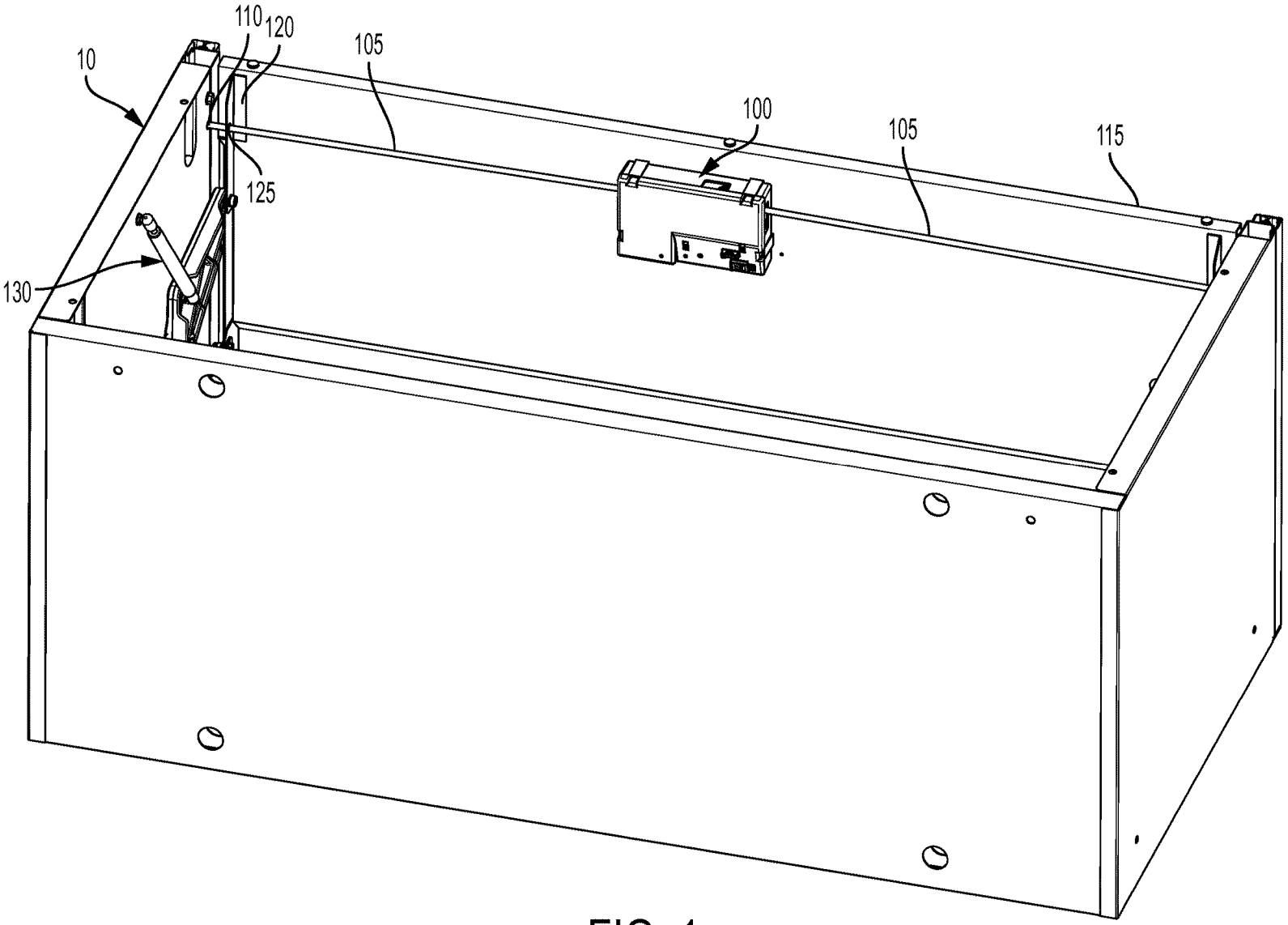
FIG. 1 is a front perspective view of an enclosure according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a door lock mechanism that rotates a cam mechanism to move one or more lock rods into either of locked and unlocked positions. The door lock mechanism can include a bias member, such as a spring, coupled to the cam mechanism for biasing the door lock mechanism into either of the locked and unlocked positions. For example, the bias member can be coupled to a cam pin at the cam mechanism, where the cam pin is located on a side of the centerline of the lock in the locked state, and located on the other side of the centerline of the lock in the unlocked state.

Other embodiments of the present invention broadly include a door lock mechanism having one or more stop mechanisms that prevent the cam mechanism from rotating past the locked and unlocked positions by abutting the lock rods when the lock rods reach either of the locked or unlocked positions. The bias member can further absorb impact from the lock rods of the door lock mechanism contacting the stop mechanisms.

Referring to FIG. 1, an embodiment of the present invention broadly includes, among other things, an enclosure 10 having a lock mechanism 100 disposed therein. The lock mechanism 100 can include one or more lock rods 105 that respectively enter into one or more apertures 110 disposed on the enclosure 10 to lock a panel 115 of the enclosure 10 in a closed state. For example, the panel 115 can be a door of the enclosure 10 that is locked when the lock mechanism 100 causes the lock rods 105 to respectively insert into the apertures 110. The enclosure 10 can further include one or more frames 120 having guide holes 125 that respectively guide the lock rods 105 into position in the apertures 110. The panel 115 can be coupled to a pneumatic or hydraulic mechanism 130 to absorb gravitational forces and allow the panel 115 to rotate downwardly with less force when the panel 115 is opened in the unlocked state. The enclosure 10 can further be disposed on wheels (not shown), or can include multiple drawers that are collectively or separately lockable by the lock mechanism 100. The lock mechanism 100 can also be implemented on any type of door, such a car door or a house door. Any other enclosure 10 or door can be implemented without departing from the spirit and scope of the present invention.

Figure 2:
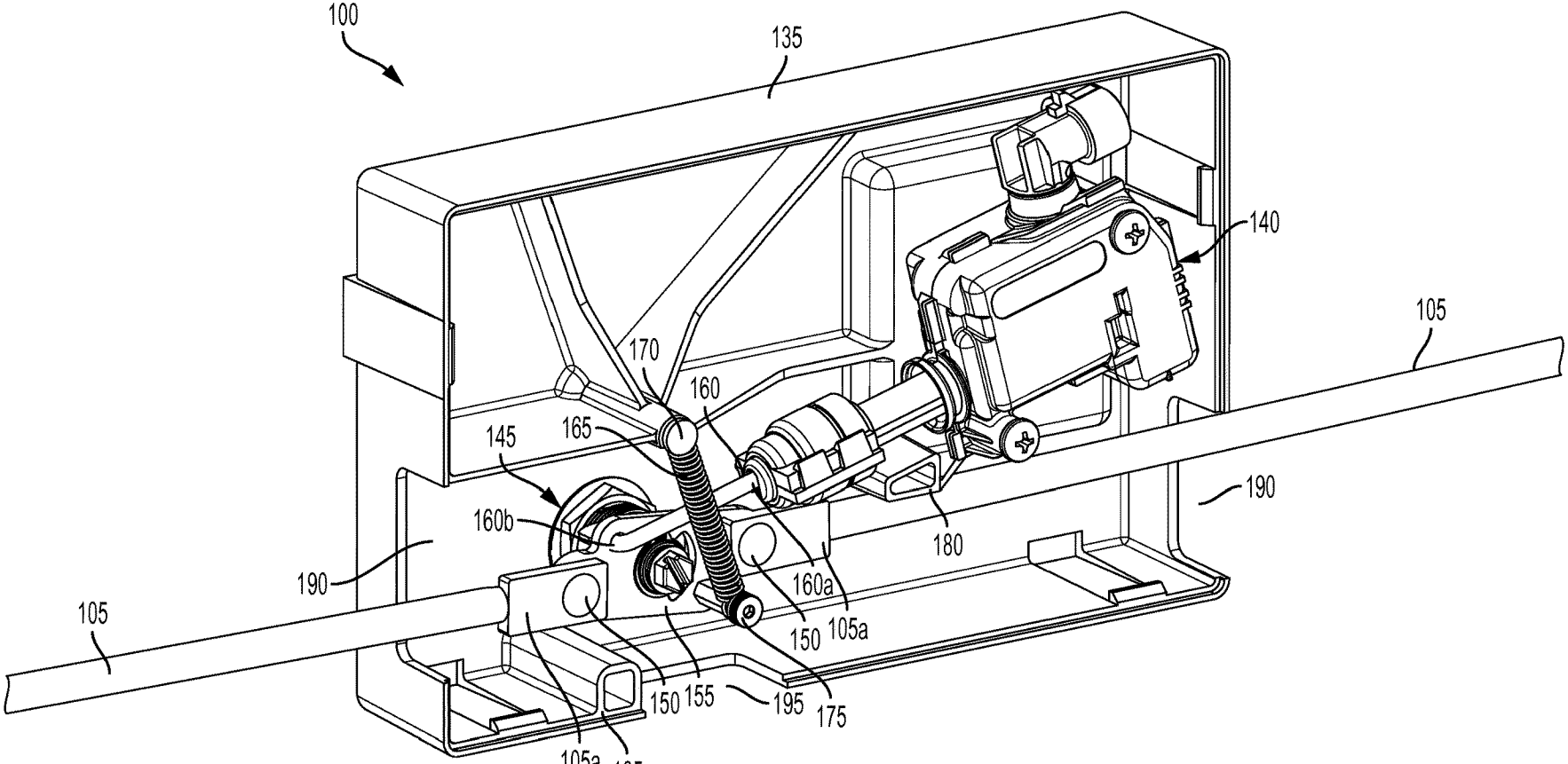
FIG. 2 is a front perspective view of the inside of a door lock mechanism according to an embodiment of the present invention.
Figure 3A:
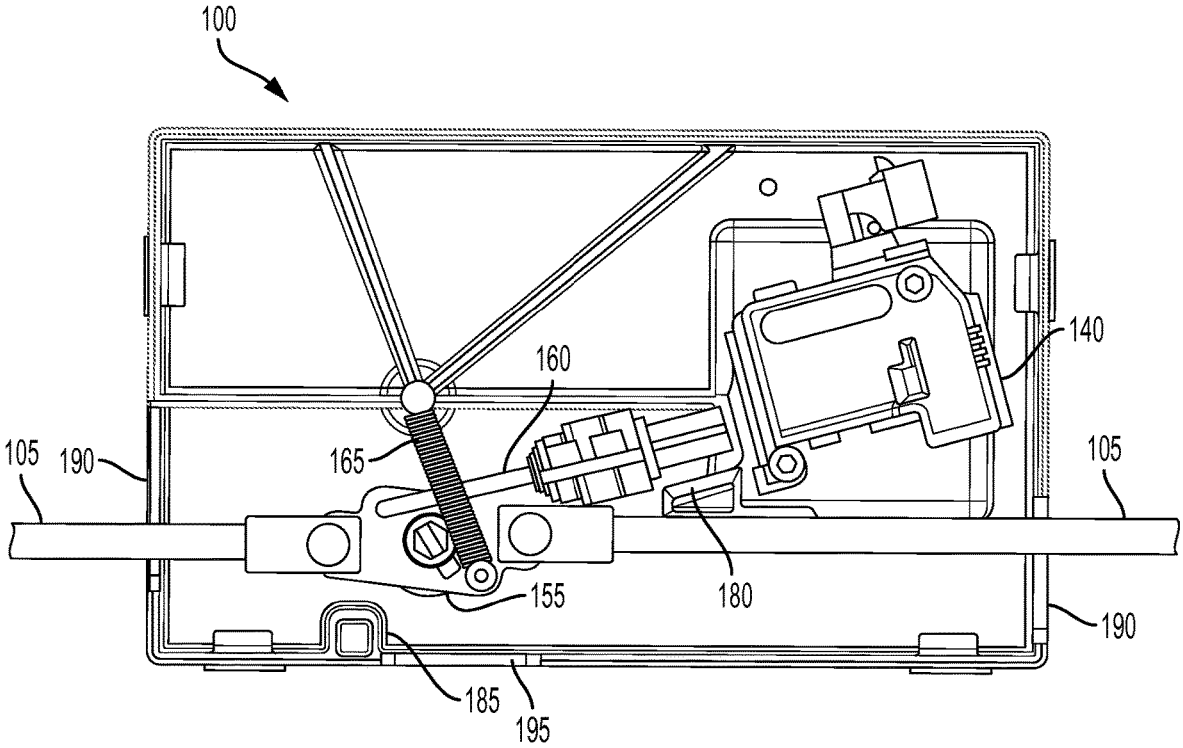
FIG. 3A is a side view of the inside of a door lock mechanism in the locked state according to an embodiment of the present invention.
Figure 3B:
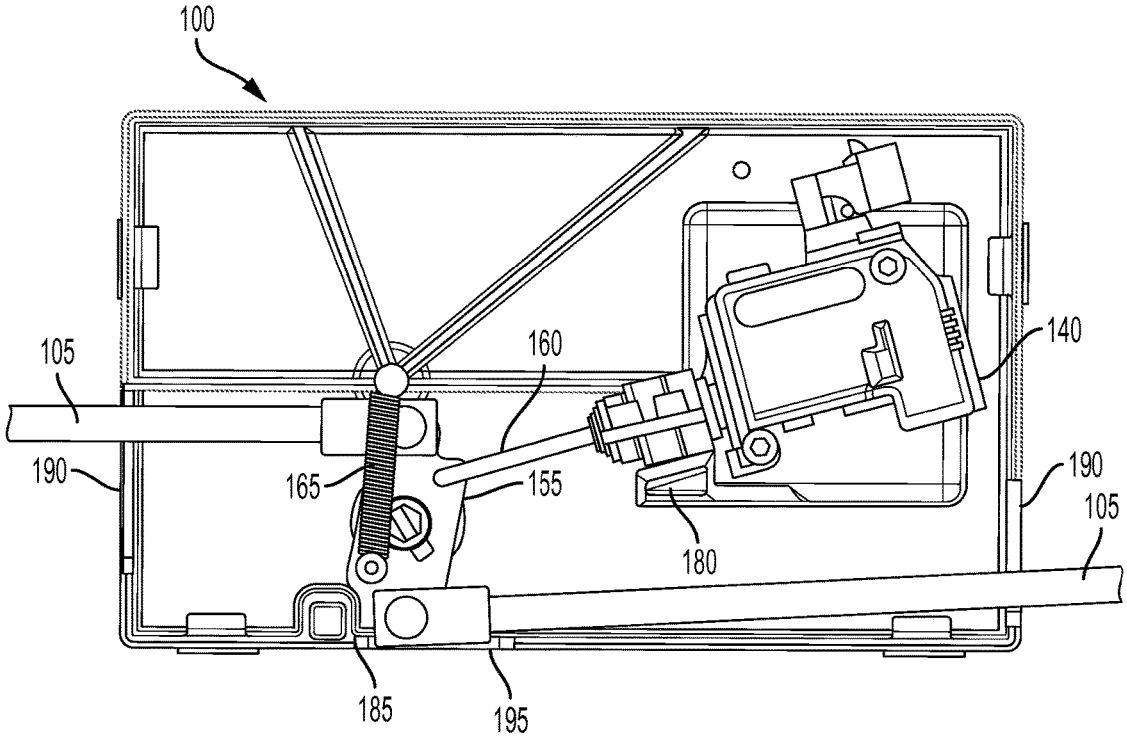
FIG. 3B is a side view of the inside of a door lock mechanism in the unlocked state according to an embodiment of the present invention.

Referring also to FIGS. 2-3B, the lock mechanism 100 can include a housing 135 enclosing the lock mechanism internal components, for example, the actuator 140. The lock mechanism 100 can further include a lock 145 that can be locked and unlocked, for example, remotely by the actuator 140 or manually with a key. The lock rods 105 can be respectively coupled with lock rod fasteners 150 to a cam mechanism 155 that, when rotated, causes the lock rods 105 to respectively engage the apertures 110 and lock the enclosure 10.

The actuator 140 can be coupled to the cam mechanism 155 by a link arm 160 with a first end 160*a* and a second end 160*b*, where the link arm 160 is linearly or otherwise movable by the actuator 140. For example, the actuator 140 can receive a signal to lock the enclosure 10, and can cause the link arm 160 to extend outwardly, thus causing the cam mechanism 155 to rotate counterclockwise (viewed in relation to FIGS. 2-3B) and lock the enclosure 10 (as shown in FIG. 3A). However, if the actuator 140 receives a signal to unlock the enclosure 10, the actuator 140 causes the link arm 160 to retract inwardly, thus causing the cam mechanism 155 to rotate clockwise (viewed in relation to FIGS. 2-3B) and unlock the enclosure 10 (as shown in FIG. 3B). The same process can be implemented manually with a key. For example, the user can insert a key into the lock 145 and rotate the lock clockwise or counterclockwise to cause the locking or unlocking of the enclosure 10 with the lock rods 105.

The lock mechanism 100 can further include a bias member 165 having opposing first and second ends. The bias member 165 can be coupled to the cam mechanism 155 at the first end and can be coupled to a housing pin 170 at the second end. For example, the bias member 165 can be coupled to the cam mechanism 155 by a cam pin 175 at the first end of the bias member 165. The housing pin 170 can be aligned with a vertical centerline of the lock 145 such that, in the locked position, the cam pin 175 is located on a first side of the centerline, and in the unlocked position, the cam pin 175 is located on a second side of the centerline opposite the first side. For example, as shown in FIG. 3A, the cam pin 175 can be located to the right of the centerline of the lock 145 in the locked position, and as shown in FIG. 3B, the cam pin 175 can be located to the left side of the lock 145 in the unlocked position.

This configuration allows the bias member 165 to bias the door lock mechanism 100 into either of the locked and unlocked states, depending on the position of the cam mechanism 155. For example, the bias member 165 biases the door lock mechanism 100 toward the locked state when the cam mechanism 155 rotates counterclockwise (as shown in FIG. 3A), and biases the door lock mechanism 100 toward the unlocked state when the cam mechanism 155 rotates clockwise (as shown in FIG. 3B). This configuration is advantageous to disposing the bias member 165 in other locations, as it allows the bias member 165 to bias the door lock mechanism 100 substantially equally toward the locked and unlocked positions, depending on the rotation of the cam mechanism 155. Any other bias mechanism can be implemented without departing from the spirit and scope of the present invention, and optionally, the present invention need not include a bias mechanism at all.

The bias member 165 can also absorb impact from the lock rods 105 impacting stops located in the housing 135. For example, a first lock rod 105 contacts an upper stop 180 when rotating toward the locked position (as shown in FIG. 3A), and the lock rod 105 contacts a lower stop 185 when rotating toward the unlocked position (as shown in FIG. 3B). Alternately, the cam mechanism 155, or any other structure, can contact the stops 180, 185. The stops 180, 185 prevent over-rotation of the door lock mechanism 100 and provide a definitive stop point for the rotation of the cam mechanism 155 to provide locking and unlocking motions that feel more controlled to the user. For example, the stops 180, 185 are disposed along the circumferential path of the lock rod 105 and positioned at the point of the circumferential path corresponding to the locked or unlocked positions. In this manner, the bias member 165 biases the lock rods 105 toward either of the locked and unlocked positions, and the stops 180, 185 contact the lock rods 105 once it reaches either one of the locked or unlocked positions, with the bias member 165 absorbing "bounce back" or other undesired forces caused by the impact of the lock rods 105 against the stops 180, 185. The stops 180, 185 also prevent damage caused by over-rotation of the door lock mechanism 100.

The actuator 140 can be any device that causes the link arm 160 to move in a desired direction. For example, the actuator 140 can be an electrical component having a transceiver that communicates with a remote control apparatus to remotely operate the actuator and remotely cause the link arm 160 to move to lock and unlock the door lock mechanism 100. Any manner of communicating with the actuator 140 can be implemented without departing from the spirit and scope of the present invention, including infrared, radio frequency identification (RFID), cellular, WIFI, Bluetooth, or any other wireless signal; or a wired connection that communicates the desired information to the actuator 140. The actuator 140 can move the link arm 160 linearly, rotationally, or in any other manner to carry out the command from the remote controller. Further, the remote controller need not be remote at all, and instead can be a local controller or interface coupled to the door lock mechanism 100, enclosure 10, or to any other item, such as, for example, a biometric sensor.

In an embodiment, the housing 135 also includes various openings to allow for the passage of the internal components of the door lock mechanism 100. For example, the housing 135 can include side openings 190 disposed on a side of the housing 135 and adapted to allow at least partial passage of the lock rods 105. The housing 135 can also include a lower opening 195 adapted to allow at least partial passage of the cam mechanism 155, bias member 165, cam pin 175, lock rods 105, or any other internal component of the door lock mechanism 100.

In an embodiment, the bias member 165 is a coil spring, but the bias member 165 can be a leaf spring, torsion or double torsion spring, tension spring, compression spring, tapered spring, or simply an object elastically biased in one manner or another. Further, the bias member 165 need not be a spring at all, or even an elastically biased object, and can be any object that causes the door lock mechanism 100 to bias toward a locked or unlocked position when the cam mechanism 155 is rotated. Any other implementation of the bias member 165, including no bias member 165 at all, can be implemented without departing from the spirit and scope of the present invention.

Figure 4:
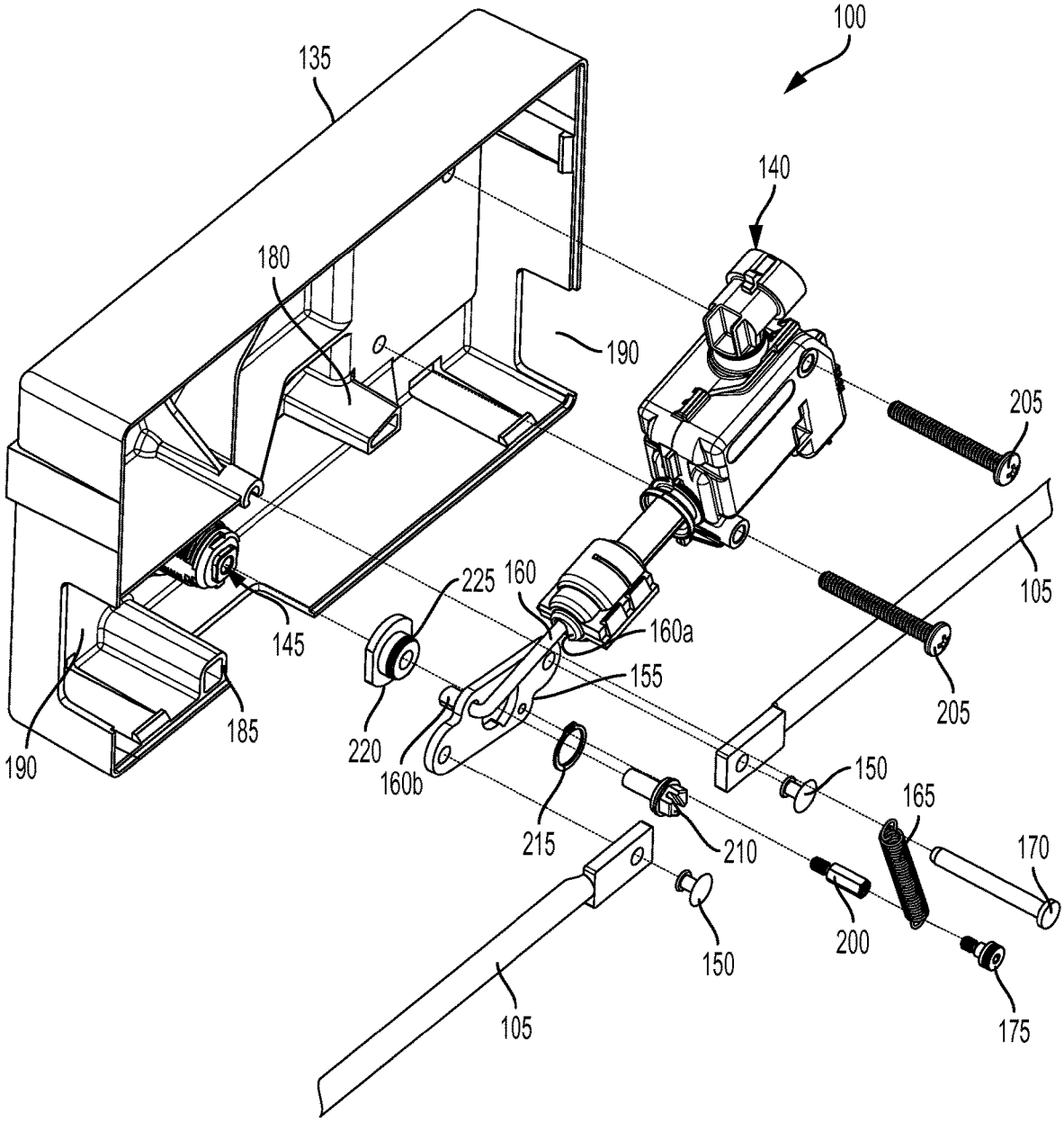
FIG. 4 is a top perspective exploded view of a door lock mechanism according to an embodiment of the present invention.

Referring to FIG. 4, the door lock mechanism 100 further includes a cam pin receiver 200 adapted to receive the cam pin 175 and couple a second end of the bias member 165 to the cam mechanism 155. For example, the cam pin 175 can include threads adapted to threadably engage internal threads of the cam pin receiver 200, similar to a nut and bolt mechanism. The cam pin receiver 200 can include external threads that threadably engage with the cam mechanism 155. Alternately, the cam pin receiver 200 can be disposed on one side of the cam mechanism 155, with the cam pin 175 located on the other side, thereby coupling the elastic member 165 to the cam mechanism 155.

The door lock mechanism 100 can further include actuator fasteners 205 adapted to couple the actuator 140 to the housing 135. For example, the actuator fasteners 205 can couple the actuator 140 to the housing 135 at an angle, such that actuation of the link arm 160 causes rotation of the cam mechanism 155, and accordingly, locking and unlocking of the door lock mechanism 100. Any other angle or orientation of the actuator 140 can be implemented without departing from the spirit and scope of the present invention.

In another embodiment, the door lock mechanism 100 further includes a lock fastener 210 coupling the lock 145 to the cam mechanism 155 by a clip 215. For example, the door lock mechanism 100 includes a lock member 220 coupled to the lock 145 and having lock member grooves 225. For example, the lock member grooves 225 can be threads or ring-shaped grooves aligned with another. The lock member 220 can be adapted to receive the clip 215 on the lock member grooves 225, or at any other portion of the lock member 220, to couple the lock member 220 to the cam mechanism 155. For example, the clip 215 can be elastically retained on any one or more of the the lock member grooves 225. In this manner, a user can manually open the door lock mechanism 100 with a key, and the key translates rotational movement of the lock 145 to the lock member 220, which will turn the cam mechanism 155 in the appropriate rotational direction to either lock or unlock the door lock mechanism 100. Any other manner of coupling the lock 145 to the cam mechanism 155 can be implemented without departing from the spirit and scope of the present invention.

The various fasteners discussed above (for example, the lock rod fasteners 150, housing pin 170, cam pin 175, cam pin receiver 200, actuator fasteners 205, lock fasteners 210, and others) can be a screw, nail, bolt, or any other type of fastener without departing from the spirit and scope of the present invention. Also, the above fasteners can be headed pins that are insertable into an opening or hole so as to reduce the required amount of tooling necessary to assemble the door lock mechanism 100.

The elements of the present invention have been discussed above in either singular or plural terms, for example, a single cam mechanism 155 and plural lock rods 105. However, the above discussion is exemplary only, and no element discussed above is limited to either a singular or plural configuration.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A lock mechanism adapted to be selectively disposed in either of locked and unlocked states, the lock mechanism comprising:

a housing;

a cam mechanism rotatably disposed within the housing;

a first lock rod coupled to the cam mechanism;

a first stop disposed on the housing and along a circumferential path of the first lock rod, the first stop abutting the first lock rod when the lock mechanism is disposed in the locked state to substantially prevent over-rotation of the cam mechanism and first lock rod, wherein the first stop is spaced from the first lock rod and cam mechanism when the lock mechanism is disposed in the unlocked state;

a second stop disposed on the housing and abutting the cam mechanism when the lock mechanism is disposed in the unlocked state, wherein the second stop is spaced from the cam mechanism when the lock mechanism is disposed in the locked state;

a bias member having first and second bias member ends, the first bias member end is coupled to the housing at a housing pin and the second bias member end is coupled to the cam mechanism at a cam pin; and a lock coupled to the housing and the cam mechanism and having a central axis extending substantially perpendicular to the first lock rod, wherein the housing pin is disposed substantially axially aligned with the centerline such that, when the lock mechanism is disposed in the locked state, the cam pin is disposed on a first side of the centerline, and when the lock mechanism is disposed in the unlocked state, the cam pin is disposed on a second side of the centerline opposite the first side.

2. The lock mechanism of claim 1, further comprising an actuator adapted to receive a command and cause movement of the cam mechanism in response to the command.

3. The lock mechanism of claim 2, further comprising a link arm coupled to the actuator at a first link arm end and coupled to the cam mechanism at a second link arm end.

4. The lock mechanism of claim 1, further comprising a lock member coupled to the lock and the cam mechanism, wherein the lock member is adapted to rotate the cam mechanism when the lock mechanism is disposed in either of the locked or unlocked states.

5. The lock mechanism of claim 4, wherein the lock member is adapted to be inserted through the cam mechanism, and further comprising a clip adapted to be coupled to the lock member on a first side of the cam mechanism opposite a second side proximate the lock to thereby couple the lock member to the cam mechanism.

6. The lock mechanism of claim 5, wherein the lock member has a lock member groove extending through an opening in the cam mechanism, and wherein the clip is adapted to be coupled to the lock member groove.

7. A lock apparatus adapted to be selectively disposed in either locked and an unlocked states, the lock apparatus comprising:

a housing;

a cam mechanism rotatably disposed within the housing;

a first lock rod coupled to the cam mechanism; a bias member having first and second bias member ends, wherein the first bias member end is coupled to the housing at a housing pin and the second bias member end is coupled to the cam mechanism at a cam pin;

a first stop disposed on the housing and along a circumferential path of the first lock rod, the first stop abutting the first lock rod when the lock apparatus is disposed in the locked state to substantially prevent over-rotation of the cam mechanism and first lock rod, wherein the first stop is spaced from the first lock rod and cam mechanism when the lock mechanism is disposed in the unlocked state; and a second stop disposed on the housing and abutting the cam mechanism when the lock apparatus is disposed in the unlocked state, wherein the second stop is spaced from the cam mechanism when the lock mechanism is disposed in the locked state.

8. The lock apparatus of claim 7, further comprising a lock coupled to the housing and the cam mechanism and having a centerline extending substantially perpendicular to the first lock rod, wherein the housing pin is disposed substantially aligned with the centerline such that, when the lock apparatus is disposed in the locked state, the cam pin is disposed on a first side of the centerline, and when the lock apparatus is disposed in the unlocked state, the cam pin is disposed on a second side of the centerline opposite the first side.

9. The lock apparatus of claim 7, further comprising an actuator adapted to receive a command and cause movement of the cam mechanism in response to the command.

10. The lock apparatus of claim 9, further comprising a link arm coupled to the actuator at a first link arm end and coupled to the cam mechanism at a second link arm end.

11. The lock apparatus of claim 7, further comprising a lock member coupled to the lock and the cam mechanism, wherein the lock member is adapted to rotate the cam mechanism when the lock apparatus is disposed in either of the locked or unlocked states.

12. The lock apparatus of claim 11, wherein the lock member is adapted to be inserted through the cam mechanism and includes a lock member groove, and further comprising a clip adapted to be coupled to the lock member at the lock member groove on a first side of the cam mechanism opposite a second side proximate the lock to thereby couple the lock member to the cam mechanism.

13. The lock apparatus of claim 7, wherein the bias member is adapted to bias the cam mechanism in a first rotational direction when the lock apparatus is in the locked state, and bias the cam mechanism in a second rotational direction opposite the first rotational direction when the lock apparatus is disposed in the unlocked state.

* * * * *